United States Patent [19]

Siwiak

[11] Patent Number: 4,516,127

[45] Date of Patent: May 7, 1985

[54] THREE ELEMENT LOW PROFILE ANTENNA

[75] Inventor: Kazimierz Siwiak, Sunrise, Fla.

[73] Assignee: Motorola, Inc., Schaumburg, Ill.

[21] Appl. No.: 489,893

[22] Filed: Apr. 29, 1983

[51] Int. Cl.[3] ..... H01Q 1/48

[52] U.S. Cl. ..... 343/702; 343/845; 343/830

[58] Field of Search ..... 343/702, 705, 708, 794, 343/803, 804, 824–826, 828–831, 845–848, 908, 741, 742

[56] References Cited

U.S. PATENT DOCUMENTS

| | | | |
|---|---|---|---|
| 2,417,793 | 3/1947 | Wehner | 343/826 |
| 2,552,816 | 5/1951 | Root | 343/702 |
| 3,151,328 | 9/1964 | Boyer | 343/742 |
| 3,268,904 | 8/1966 | Noguchi et al. | 343/908 |
| 3,488,657 | 1/1970 | Pressel et al. | 343/845 |
| 3,780,373 | 12/1973 | Holst et al. | 343/788 |
| 4,041,497 | 8/1977 | Palmaer | 343/702 |
| 4,051,478 | 9/1977 | Kaloi | 343/700 MS |
| 4,123,756 | 10/1978 | Nagata et al. | 343/702 |
| 4,313,119 | 1/1982 | Garay et al. | 343/702 |

FOREIGN PATENT DOCUMENTS

| | | | |
|---|---|---|---|
| 57-30402 | 2/1982 | Japan | 343/829 |

OTHER PUBLICATIONS

R. D. Wanselow, and D. W. Milligan, "A Compact, Low Profile, Transmission Line Antenna-Tunable Over Greater than Octave Bandwidth", IEEE Transactions on Antennas and Propagation, vol. AP-14, No. 6, Nov. 1966, pp. 701-707.

The Radio Amateur's Handbook, 1982, Chapter 19, "Transmission Lines", Sub-Title Folded Dipoles, pp. 19-4-19-5, published by the Amer. Radio Relay League, Newington, Conn.

*Primary Examiner*—E. Lieberman
*Assistant Examiner*—Michael C. Wimer
*Attorney, Agent, or Firm*—Joseph T. Downey; Edward M. Roney; James W. Gillman

[57] ABSTRACT

A low profile antenna is provided which includes a counterpoise above which are situated three parallel oriented L-shaped elements. Each of the elements includes leg and foot portions. One common end of the leg portions of the elements are electrically coupled together and to an antenna trimming stub. The remaining end of the middle element constitutes the feedpoint of the antenna together with the remaining ends of the other two elements. The dimensions of the counterpoise top surface are selected to be substantially less than one wavelength at the desired operating frequency of the antenna. In this manner, the antenna generates or is responsive to radio frequency waves exhibiting two polarizations.

6 Claims, 6 Drawing Figures

THREE ELEMENT LOW PROFILE ANTENNA

BACKGROUND OF THE INVENTION

This invention relates to low profile antennas and, more particularly to low profile antennas capable of radiating electromagnetic energy exhibiting more than one polarization for use on portable data terminals and other transmitting and receiving radio apparatus which may be operated in a plurality of different spatial orientations.

DESCRIPTION OF THE PRIOR ART

In the past, many portable radio devices and associated equipment have employed vertical antennas for transmitting or receiving purposes. Unfortunately, such vertical antennas tend to significantly increase the overall dimensions of the portable radio device. These vertical antennas radiate and receive radio signals which are vertically polarized. This can result in signal degradation if the portable radio is frequently subjected to substantial changes of orientation, that is from vertical to horizontal orientation and in between.

In an effort to reduce the overall height of vertical antennas employed on portable radio devices, such antennas are often compressed into helical-type vertical antennas. Unfortunately, although such helical antennas exhibit a reduced overall vertical dimension, they are not as efficient as their full-size vertical counterparts. Moreover, such helical vertical antennas exhibit the same single direction polarization drawbacks as their full-size vertical counterparts.

It is one object of the present invention to provide a low profile antenna which avoids the functional and aesthetic size problems associated with conventional antennas for portable radio devices.

Another object of the invention is to provide a low profile antenna which radiates electromagnetic energy with two polarizations so as to lessen the undesirable effect of changing the orientation of a portable radio device to which the antenna is attached.

These and other objects of the invention will become apparent to those skilled in the art upon consideration of the following description of the invention.

BRIEF SUMMARY OF THE INVENTION

The present invention is directed to providing an antenna which exhibits a low profile and which is capable of radiating electromagnetic energy having two polarizations.

In accordance with one embodiment of the invention, a low profile antenna includes a counterpoise of electrically conductive material having a first surface. The antenna further includes first, second, and third L-shaped elements, each of these elements having respective leg and foot portions and ends. The leg portions of each of the elements are oriented substantially parallel to each other and in a plane substantially parallel to, and a predetermined first distance above, the first surface. The second element is situated between the first and third elements. Those ends of the first, second, and third elements which are situated on the leg portions thereof are electrically connected together. The ends of the first and third elements which are situated on the foot portions thereof are electrically connected to the counterpoise and together with the end of the second element situated on the foot portion thereof constitute the feedpoint of the antenna.

The features of the invention believed to be novel are set forth with particularity in the appended claims. The invention itself, however, both as to organization and method of operation, together with further objects and advantages thereof, may best be understood by reference to the following description taken in conjunction with the accompanying drawings.

DETAILED DESCRIPTON OF THE PREFERRED EMBODIMENT

Figure 1:
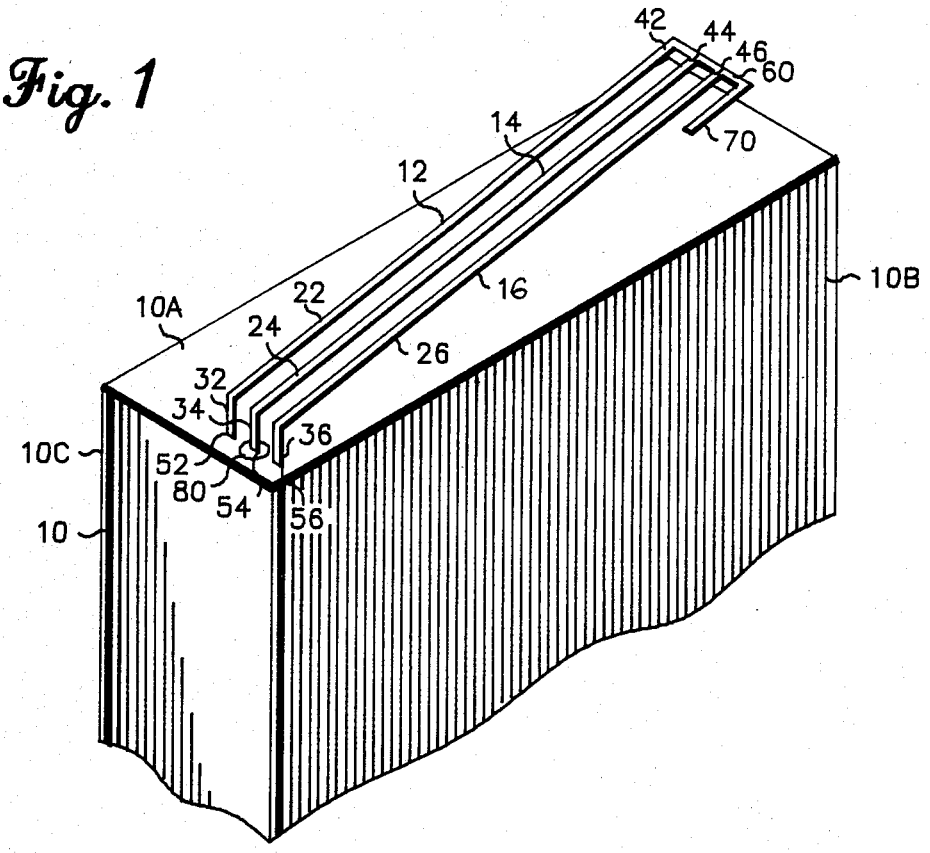
FIG. 1 is a perspective view of the antenna of the present invention shown mounted diagonally on one end of a box representing a portable radio device.

FIG. 1 shows one embodiment of the antenna of the present invention situated on and above an end surface 10A of a box 10 which represents a portable data terminal or other radio device. Surface 10A is fabricated from metallic material for counterpoise purposes. Additionally, sufficient portions of surfaces 10B, 10C, 10D, and 10E are fabricated of metallic material to provide a substantial electrically-conductive path along the long, vertical dimension of the radio device of FIG. 1. Thus, surface 10A, together with surfaces 10B, 10C, 10D, and 10E form the counterpoise of the antenna and will henceforth be referred to as counterpoise surfaces. Surface 10B is the bottom surface of portable data terminal 10 which generally would be situated on a table top. Surface 10C (not fully shown) represents a side of the portable data terminal 10 on which a user keyboard is situated. Surface 10C is the box surface opposite surface 10B.

As seen in FIG. 1, the present antenna includes elements 12, 14, and 16. Elements 12, 14, and 16 are L-shaped and include leg portions 22, 24, and 26, respectively, and foot portions 32, 34, and 36, respectively. Element 12 includes ends 42 and 52 situated on the leg portion 22 and foot portion 32, respectively thereof. Element 14 includes ends 44 and 54 situated on the leg portion 24 and foot portion 34, respectively thereof. Element 16 includes end 46 and 56 situated on leg portion 26 and foot portion 36, respectively thereof, as shown in FIG. 1.

A connecting member 60 fabricated from electrically conductive material electrically connects ends 42, 44, and 46 together as shown in FIG. 1. A tuning stub or element 70 is coupled to connecting member 60 to permit easy adjustment of the desired operating frequency of the antenna in a manner described later in more detail.

Ends 52 and 56 of foot portions 32 and 36, respectively, are electrically coupled to surface 10A which together with the remaining surfaces of radio device 10 constitute the counterpoise of the antenna of the present invention. End 54 of foot portion 34 is fed with radio frequency energy supplied from a source interior to radio device 10 through the center of an insulator 80 which prevents end 54 from undesirably shorting to counterpoise surface 10A. End 54 of center element 14 together with ends 52 and 56 coupled to counterpoise surface 10A (ground) constitute the feed point of the antenna of FIG. 1.

Figure 2:
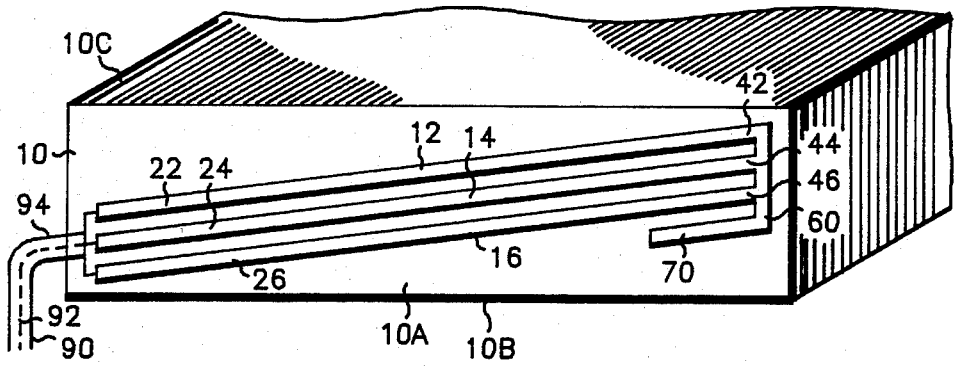
FIG. 2 is another perspective view of the antenna of FIG. 1.

Alternatively, as shown in FIG. 2, the feed point of the antenna of the invention is fed in an unbalanced manner by a coaxial cable 90 coupled thereto. Coaxial cable 90 includes a center conductor 92 electrically coupled to center element 14. Coaxial cable 90 further includes a shield conductor 94 electrically coupled to ends 52 and 56, (see FIG. 1) respectively via counterpoise surface 10A. The three element structure described above presents an input impedance of approximately 40 ohms at the feedpoint of the antenna. Thus, a 50 ohm coaxial cable such as RG174/U may be suitably employed to couple radio frequency energy to and from the antenna. Elements 12 and 16 act to raise the impedance of the antenna to such useable levels.

Figure 3:
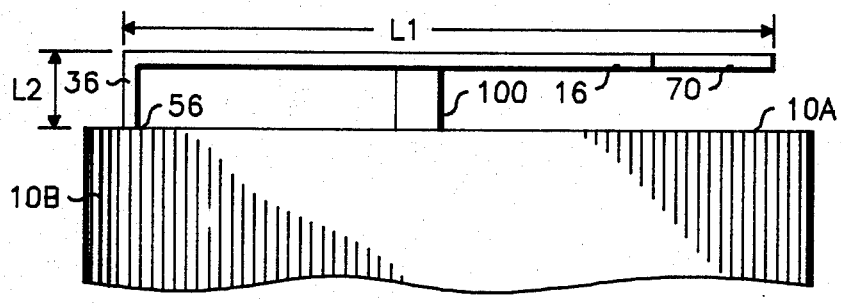
FIG. 3 is a side view of the antenna of FIG. 1 shown with an insulative center support.

FIG. 3 is a side view of the antenna of the invention. Due to the substantially parallel nature of elements 12, 14, and 16, only portions of element 16 and tuning stub 70 are seen in FIG. 3. In this embodiment of the invention, a small support structure 100 is shown situated between elements 12, 14, and 16, and counterpoise surface 10A to furnish the antenna with additional structural integrity. Although support structure 100 is not essential, it is helpful in strengthening the antenna. Support structure 100 is fabricated from electrically insulative material, for example, low dielectric material or plastic material. Support structure 100 is sufficiently small such that it does not couple substantial radio frequency energy from antenna elements 12, 14, and 16 to counterpoise surface 10A.

The leg portions of elements 12, 14, and 16, namely portions 22, 24 and 26 exhibit a length approximately equal to one quarter of the wavelength at the desired antenna operating frequency, which in this embodiment of the invention is approximately 830–860 MHz. Thus, in this embodiment, L1 approximately equals 7.3 centimeters. The foot portions 32, 34, and 36 of elements 12, 14, and 16, respectively, exhibit a length of L2 wherein L2 is approximately equal to 0.9 centimeters in this embodiment. Elements 12, 14, and 16 are conveniently fabricated from number 15 copper wire having a diameter of 0.145 centimeters.

Figure 4:
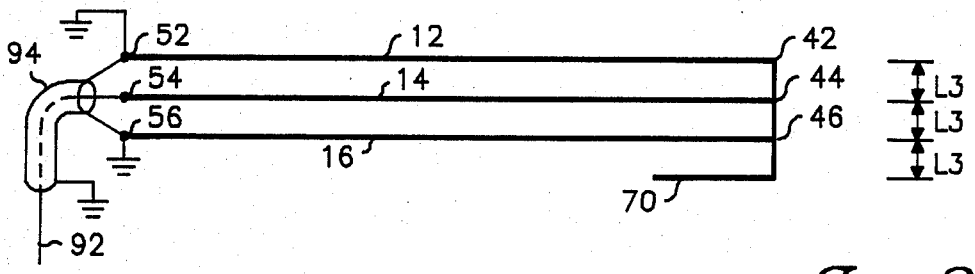
FIG. 4 is an equivalent electrical schematic representation of the antenna of FIG. 1.

FIG. 4 is a representation of the electrical schematic equivalent circuit for the antenna of the present invention. It is noted that the spacing among elements 12, 14, and 16 is equal to L3 which is approximately 0.14 centimeters in this embodiment of the invention. Element ends 52 and 56 are coupled to ground as shown and together with element 54 form the feedpoint of the antenna. Element ends 42, 44, and 46 are coupled together and to a tuning stub 70, all as previously described in the detailed physical description of the antenna.

Returning again to FIGS. 1 and 2, it is seen that counterpoise surface 10A exhibits a substantially rectangular geometry. Further, it is noted that the leg portions 22, 24, and 26 of the elements are oriented along one diagonal of rectangular counterpoise surface 10A. This diagonal orientation not only conserves valuable space in the radio device, but also enhances the operation of the subject antenna in the following manner. When radio device 10 is placed on a table or metallic surface, radio frequency electric fields which usually exist between elements 12, 14, and 16 and counterpoise surface 10A, also form between elements 12, 14, and 16 and the table or metallic surface. Enhanced radiation with a polarization perpendicular to the table or metallic surface results.

For the present antenna to operate properly, it is important that the maximum dimension of the counterpoise upon which it is situated is substantially less than one wavelength at the desired operating frequency of the antenna. If the dimensions of the counterpoise surface 10A were to become so large as to be a semi-infinite ground plane or a full ground plane, then radio frequency energy supplied to the antenna would excite only one polarization. However, when the maximum dimension of the counterpoise, especially that of surface 10A, is substantially less than one wavelengh at the desired antenna operating frequency, then radio frequency fields exhibiting two polarizations are generated when the antenna is supplied with radio frequency energy. This is believed to be due to a scattering effect of radio frequency energy from the antenna off the edges of the relatively small surface 10A of the counterpoise therebelow. In this embodiment of the invention, the diagonal dimension of the rectangular counterpoise is approximately equal to 8.3 centimeters which is substantially less than the wavelength at the desired operating frequency of approximately 830–860 MHz.

Tuning or trimming stub 70 which is a relatively short metallic element coupled to connecting member 60 and oriented substantially parallel to elements 12, 14, and 16 enables simplified tuning of the present antenna without the need for physically cutting and trimming the ends of the elements. Trimming stub 70 exhibits a length of approximately 1.2 centimeters. Trimming of stub 70 achieves a frequency variation of approximately 5 MHz per 1 millimeter trimmed. That is, for each 1 mm. trimmed off stub 70, the operating frequency of the antenna is increased by 5 MHz.

Figure 5:
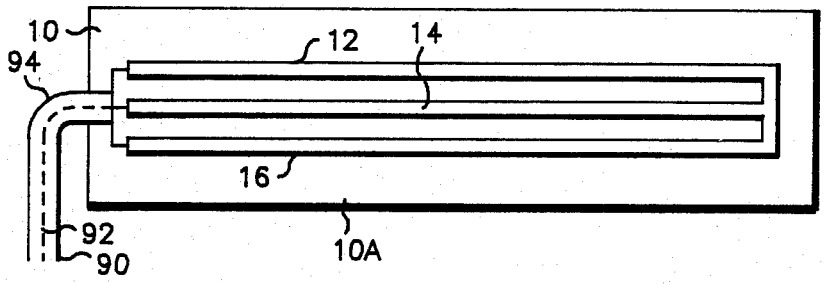
FIG. 5 shows another embodiment of the antenna of the present invention.

FIG. 5 shows an alternative embodiment of the invention wherein the leg portions of L-shaped elements 12, 14, and 16 are oriented substantially parallel to the longer dimension of a rectangular counterpoise surface 10A. More specifically, elements 12, 14, and 16 are shown oriented along the horizontal bisector of the rectangular counterpoise surface 10A.

Figure 6:
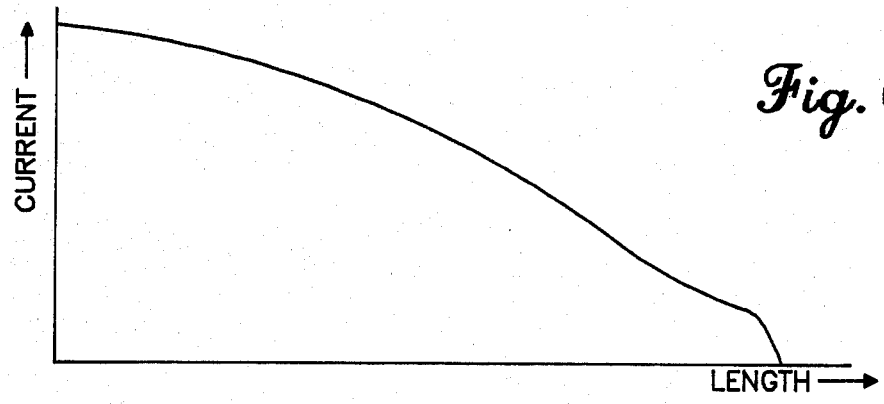
FIG. 6 is a graphical representation of the current distribution of the antenna of the present invention.

FIG. 6 is a current distribution graph of the antenna of the present invention. Relative antenna current versus relative antenna length are plotted. It is seen that when the antenna is excited at the feedpoint, antenna current is relatively high at the feedpoint and decreases toward ends 42, 44, and 46.

Those skilled in the art will appreciate that the antenna described herein may be employed for either transmitting or receiving purposes. Further, the dimensions of the antenna may be either scaled up or scaled down depending on the desired antenna operating frequency, provided that the dimensions of the counterpoise are similarly scaled.

The foregoing describes a low profile antenna capable of generating radio frequency fields exhibiting more than one polarizaiton. The antenna achieves superior performance even though subjected to a number of different spatial orientations.

While only certain preferred features of the invention have been shown by way of illustration, many modifications and changes will occur to those skilled in the art. It is, therefore, to be understood that the present claims are intended to cover all such modifications and changes as fall within the true spirit of the invention.

What is claimed is:

1. An antenna comprising:

a counterpoise of electrically conductive material having a first surface;

first, second, and third L-shaped elements, each of said elements having respective leg and foot portions and ends, the leg portions of each of said elements being oriented substantially parallel to each other and in a plane substantially parallel to, and a predetermined first distance above said first surface, said second element being situated between said first and third elements, the ends of said first, second, and third elements situated on the leg portions thereof being electrically connected together, the ends of said first and third elements situated on the foot portions thereof being electrically connected to said counterpoise and together with the end of said second element situated on the foot portion thereof constituting the feedpoint of said antenna.

2. The antenna of claim 1 wherein the first surface of said counterpoise is substantially rectangular, said first, second, and third elements, being oriented along a diagonal of said rectangular first surface.

3. The antenna of claim 1 wherein the largest dimension of said counterpoise first surface is substantially less than the wavelength of the desired operating frequency of the antenna.

4. The antenna of claim 1 wherein the length of said first, second and third element is approximately equal to one quarter of the wavelength of the desired operating frequency of the antenna.

5. The antenna of claim 1 wherein the first surface of said counterpoise is substantially rectangular, said first, second, and third elements being oriented along a line which lengthwise bisects said rectangular surface.

6. The antenna of claim 1 including a trimming stub of electrically conductive material situated parallel to the leg portions of said first, second, and third elements and being electrically coupled to the ends of said elements furthest from said feedpoint.

* * * * *